US005708952A

United States Patent [19]

Taniguchi et al.

[11] Patent Number: 5,708,952

[45] Date of Patent: Jan. 13, 1998

[54] CLEANING UNIT FOR AN IMAGE-FORMING MACHINE HAVING A TONER CONVEYING MECHANISM

[75] Inventors: Susumu Taniguchi; Hiroki Morishita; Shinichi Kotera, all of Osaka, Japan

[73] Assignee: Mita Industrial Co., Ltd., Osaka, Japan

[21] Appl. No.: 680,012

[22] Filed: Jul. 15, 1996

[30] Foreign Application Priority Data

Jul. 26, 1995 [JP] Japan ..... 7-190639
Jul. 26, 1995 [JP] Japan ..... 7-190640
Jul. 26, 1995 [JP] Japan ..... 7-190642

[51] Int. Cl.[6] ..... G03G 21/00

[52] U.S. Cl. ..... 399/358; 399/120; 399/360

[58] Field of Search ..... 399/98, 102, 103, 399/105, 106, 119, 120, 358, 360

[56] References Cited

U.S. PATENT DOCUMENTS

| | | | |
|---|---|---|---|
| 4,501,484 | 2/1985 | Shimura | 399/164 |
| 4,941,022 | 7/1990 | Ohmura et al. | 399/358 |
| 5,020,697 | 6/1991 | Koiso et al. | 222/325 |
| 5,574,549 | 11/1996 | Sundquist | 399/262 |
| 5,594,541 | 1/1997 | Bonislawski, Jr. et al. | 399/358 |

FOREIGN PATENT DOCUMENTS 61-093480 5/1986 Japan .

*Primary Examiner*—Arthur T. Grimley
*Assistant Examiner*—Quana Grainger
*Attorney, Agent, or Firm*—Beveridge, DeGrandi, Weilacher & Young, L.L.P.

[57] ABSTRACT

An imaging unit comprising a frame means, an image-carrying means mounted on the frame means, a developing means and a cleaning means. The cleaning means includes a toner conveying pipe member made of a synthetic rubber for defining a passage for conveying the toner removed from the image-carrying means, a toner conveying means for conveying the toner through the toner conveying pipe member, and a toner-recovering container detachably combined to the toner conveying pipe member. When the toner-recovering container is combined to the toner conveying pipe member, the toner discharge opening formed in the side surface of the toner conveying pipe member is communicated with the toner receiving opening formed in the toner-recovering container. A positioning member is disposed to place the toner discharge opening and the toner receiving opening in positions relative to each other. There are further disposed a shutter member capable of moving between a close position for closing the toner discharge opening and an open position for opening the toner discharge opening, and a resilient urging means for resiliently urging the shutter member toward the close position. When the toner-recovering container is combined to the toner conveying pipe member, the shutter member is caused to move from the close position along the toner conveying pipe member and is then caused to move in a direction to separate away from the side surface of the toner conveying pipe member to arrive at the close position.

17 Claims, 6 Drawing Sheets

CLEANING UNIT FOR AN IMAGE-FORMING MACHINE HAVING A TONER CONVEYING MECHANISM

FIELD OF THE INVENTION

The present invention relates to an imaging unit applied to an image-forming machine of the type which develops an electrostatic latent image into a toner image and transfers the toner image onto a transfer member, such as copying machine, printer or facsimile; and to a toner conveying mechanism.

DESCRIPTION OF THE PRIOR ART

An image-forming machine of the type which develops an electrostatic latent image into a toner image and transfers the toner image onto a transfer member, is equipped with an imaging unit installed on a predetermined place in a housing. The imaging unit has a frame means which is generally equipped with an image-carrying means, a developing means and a cleaning means. The image-carrying means is favorably constituted by a rotary drum having an electrostatic photosensitive material arranged on the surface thereof. An electrostatic latent image is formed on the image-carrying means by a suitable system, and is developed into a toner image by the action of the developing means. The toner image is then transferred onto a transfer member such as common paper and then, the toner staying on the image-carrier means is removed by the action of the cleaning means.

The cleaning means includes a toner-recovering container that can be detachably attached. The toner removed from the image-carrying means is conveyed by a toner conveying mechanism and is recovered into the toner-recovering container. A typical toner conveying mechanism is constituted by a toner conveying pipe member which extends slenderly, and a metallic coil member which is arranged in the toner conveying pipe member and is driven to rotate. The toner conveying pipe member has a toner discharge opening and the toner-recovering container has a toner receiving opening. The toner conveyed through the toner conveying pipe member is sent into the toner-recovering container through the toner discharge opening and the toner receiving opening. In order to prevent the scattering of toner from the toner discharge opening in a state where the toner-recovering container has not been mounted, a shutter member is provided to move between a close position where the toner discharge opening is closed and an open position where the toner discharge opening is open, and a sealing member is arranged so as to be compressed between the toner conveying pipe member and the shutter member when the shutter member is brought to the close position.

The above-mentioned conventional imaging unit, however, involves the following problems that must be solved.

First, in order that the toner conveyed through the toner conveying pipe member and discharged from the toner discharge opening formed in the toner conveying pipe is permitted to enter into the toner-recovering container from the toner receiving opening formed in the toner-recovering container without scattering around, it is important that the toner discharge opening and the toner receiving opening are in very good alignment with each other and the toner-recovering container and the toner conveying pipe member are placed in positions relative to each other. Here, a means required for positioning the toner-recovering container and the toner conveying pipe member relative to each other, however, is considerably complex and hence, the cost of production is raised. When the toner conveying pipe member is made of a soft material, in particular, the positional relationship loses stability unless the position of a portion where the toner discharge opening is formed in the toner conveying pipe member is set sufficiently precisely and the position of a required portion of the toner conveying pipe member is set similarly. This, however, requires a considerably complex positioning means.

Second, when the toner discharge opening is formed in the side surface of the toner conveying pipe member and the shutter member for the toner discharge opening is mounted on a frame member which is separate from the toner conveying pipe member, a predetermined relationship must be established by the toner conveying pipe member and the shutter member. In this case, the sealing member interposed between the side surface of the toner conveying pipe member and the inner surface of the shutter member is likely to be damaged because it is relatively moved, in a compressed state, to the inner surface of the shutter member or to the side surface of the toner conveying pipe member.

Third, when a metallic coil member that extends in the toner conveying pipe member rotates in a state where the toner is not present in a sufficient amount in the toner conveying pipe member, the inner peripheral surface of the toner conveying pipe member is rubbed by the coil member to produce a considerably large noise. When the toner exists in a sufficient amount in the toner conveying pipe member, then, the lubricating action is exhibited by the toner, and the noise decreases.

SUMMARY OF THE INVENTION

It is, therefore, a first object of the present invention to provide a novel and improved imaging unit in which the toner discharge opening of the toner conveying pipe member is brought into sufficiently precise alignment with the toner receiving opening of the toner-recovering container by using a relatively simpler and inexpensive positioning member.

A second object of the present invention is to provide an imaging unit of a type comprising a toner conveying pipe member, a shutter member for opening and closing the toner discharge opening formed in the side surface of the toner conveying pipe member, the toner conveying pipe member and the shutter member being separately mounted on the frame means, and a sealing member which is compressed between the side surface of the toner conveying pipe member and the shutter member, wherein the sealing member is reliably prevented from being damaged when the toner conveying pipe member and the shutter member are related to each other as required.

A third object of the present invention is to decrease the noise produced by the revolution of the coil member to a sufficiently lower level even when the toner is not present in a sufficient amount in the toner conveying pipe member by improving the toner conveying mechanism which is constituted by a toner conveying pipe member and a metallic coil member which revolves extending through the toner conveying pipe member.

In order to accomplish the above-mentioned first object according to a first aspect of the present invention, a positioning member is disposed on a frame means, the positioning member forming a first coupling means coupled to the toner conveying means near the toner discharge opening and a second coupling means coupled to the toner-recovering container near the toner receiving opening, and the toner discharge opening of the toner conveying pipe member and the toner receiving opening of the toner-recovering container are positioned relative to each other via the positioning member.

In order to accomplish the above-mentioned first object according to the first aspect of the present invention, there is provided an imaging unit applied to an image-forming machine, comprising a frame means, an image-carrying means mounted on said frame means, and a cleaning means mounted on said frame means, wherein a toner image is formed on said image-carrying means and is transferred onto a transfer member, and the toner remaining on said image-carrying means after the toner image has been transferred is removed from said image-carrying means by said cleaning means, and said cleaning means includes a toner conveying pipe member for defining a passage for conveying the toner removed from said image-carrying means, a toner conveying means for conveying the toner through said toner conveying pipe member, and a toner-recovering container detachably combined to said toner conveying pipe member, a toner discharge opening is formed in said toner conveying pipe member, a toner receiving opening is formed in said toner-recovering container, and said toner discharge opening is communicated with said toner receiving opening when said toner-recovering container is combined to said toner conveying pipe member; characterized in that a positioning member is disposed on said frame member, said positioning member including a first coupling means coupled to said toner conveying means near said toner discharge opening and a second coupling means coupled to said toner-recovering container near said toner receiving opening, and said toner discharge opening of said toner conveying pipe member and said toner receiving opening of said toner-recovering container are positioned relative to each other via said positioning member.

According to a second aspect of the present invention, the toner discharge opening is formed in the side surface of the toner conveying pipe member, a shutter member capable of moving between a close position for closing the toner discharge opening and an open position for opening the toner discharge opening is disposed on the frame means, a sealing member is disposed so as to be compressed between the side surface of the toner conveying pipe member and the inner surface of the shutter member when the shutter member is brought to the close position, and a guide means is disposed to limit the moving passage of the shutter member between the close position and the open position, the guide means permitting the shutter member to move along the toner conveying pipe member and to move in a direction to separate away from, or approach, the side surface of the toner conveying pipe member.

In order to accomplish the above-mentioned second object according to the second aspect of the present invention, there is provided an imaging unit applied to an image-forming machine, comprising a frame means, an image-carrying means mounted on said frame means, and a cleaning means mounted on said frame means, wherein a toner image is formed on said image-carrying means and is transferred onto a transfer member, and the toner remaining on said image-carrying means after the toner image has been transferred is removed from said image-carrying means by said cleaning means, and said cleaning means includes a toner conveying pipe member for defining a passage for conveying the toner removed from said image-carrying means, a toner conveying means for conveying the toner through said toner conveying pipe member, and a toner-recovering container detachably combined to said toner conveying pipe member, a toner discharge opening is formed in said toner conveying pipe member, a toner receiving opening is formed in said toner-recovering container, and said toner discharge opening is communicated with said toner receiving opening when said toner-recovering container is combined to said toner conveying pipe member, characterized in that said toner discharge opening is formed in the side surface of said toner conveying pipe member, a shutter member capable of moving between a close position for closing the toner discharge opening and an open position for opening the toner discharge opening is disposed on said frame means, a sealing member is disposed so as to be compressed between the side surface of said toner conveying pipe member and the inner surface of said shutter member when said shutter member is brought to the close position, and a guide means is disposed to limit the moving passage of said shutter member between said close position and said open position, said guide means permitting said shutter member to move along said toner conveying pipe member and to move in a direction to separate away from, or approach, the side surface of said toner conveying pipe member.

According to a third aspect of the present invention, the toner conveying pipe member is made of a synthetic rubber.

That is, according to the third aspect of the present invention, there is provided a toner conveying mechanism comprising a toner conveying pipe member and a toner conveying means for conveying the toner through said toner conveying pipe member, said toner conveying means being constituted by a metallic coil member which revolves extending through said toner conveying pipe member, wherein said toner conveying pipe member is made of a synthetic rubber.

It is desired that the positioning member is made of a synthetic resin. Preferably, the end of the toner conveying pipe member is open, the first coupling means of the positioning member is inserted in the toner conveying pipe member through the open end of the toner conveying pipe member in order to limit the position of the end of the toner conveying pipe member and to close the end of the toner conveying pipe member. The toner-recovering container has a limiting groove, and the second coupling means of the positioning member is inserted in the limiting groove of the toner-recovering container to limit the position of the toner-recovering container.

It is desired that the synthetic rubber has a hardness of from 50 to 70, particularly from 55 to 65, as measured by the spring-type hardness test model-A stipulated under JIS-K-6301.

In a preferred embodiment, provision is made of a resilient urging means for resiliently urging the shutter member to the close position, said shutter member has a to-be-contacted portion, said toner-recovering container has a contact portion, and when said toner-recovering container is combined to said toner conveying pipe member, said contact portion acts on said to-be-contacted portion causing said shutter member to move to said open position from said close position against the action of said resilient urging means. When the shutter member moves from the close position to the open position, the guide means moves along the toner conveying pipe member and further moves in a direction to separate away from the side surface of the toner conveying pipe member. A developing means for developing the electrostatic latent image formed on said image-carrying means into a toner image is mounted on the frame means, the developing means including a developing roller which is resiliently pushed against the image-carrying means and a detachable toner cartridge, said toner-recovering container is mounted on said toner cartridge, and said toner cartridge is mounted on said frame means and combined to said toner conveying pipe member by mounting it on said developing means, and a resilient urging force exerted on said toner-recovering container by said resilient urging means via said shutter member in a state where said shutter member is located at said open position is in a direction substantially not affecting the pushing force of said developing roller against said image-carrying means.

DETAILED DESCRIPTION OF THE PREFERRED EMBODIMENTS

Preferred embodiments of the imaging unit constituted according to the present invention will be described in detail with reference to the accompanying drawings.

Figure 1:
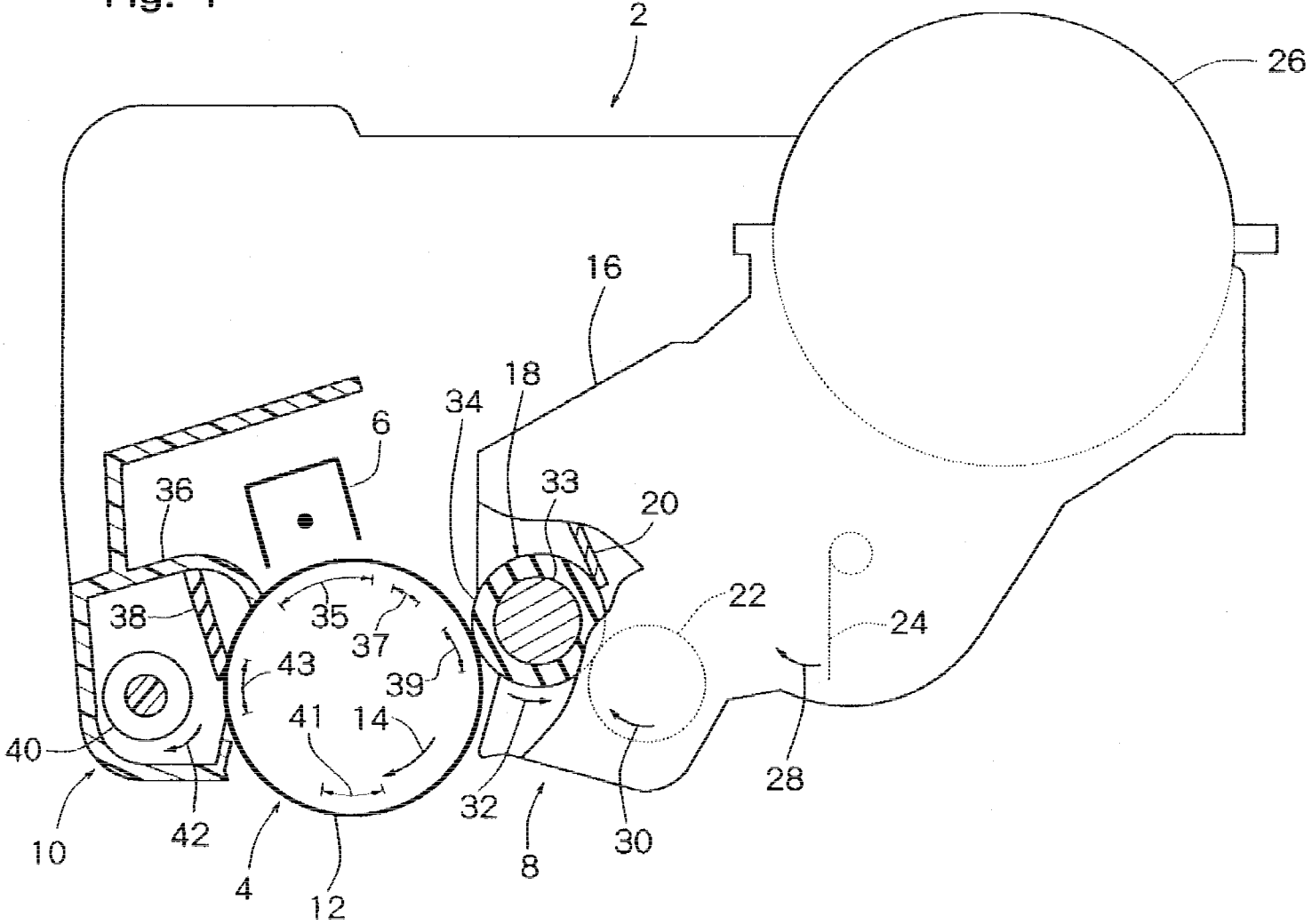
FIG. 1 is a schematic sectional view illustrating a preferred embodiment of an imaging unit constituted according to the present invention.

FIG. 1 schematically illustrates a preferred embodiment of an imaging unit constituted according to the present invention. The imaging unit has a frame means which is generally designated at 2. The frame means 2 can be made of a suitable synthetic resin. The frame means 2 is equipped with an image-carrying means 4, a charging means 6, a developing means 8 and a cleaning means 10. The image-carrying means 4 is constituted by a rotary drum 12 having an electrostatic photosensitive material arranged on the peripheral surface thereof. The rotary drum 12 is rotated in a direction indicated by an arrow 14. The charging means 6 is constituted by a corona discharger for electrically charging the peripheral surface of the rotary drum 12 to a predetermined polarity.

The developing means 8 is equipped with a developing housing 16 in which are mounted a developing roller 18, a developing agent limiting member 20, a developing agent replenishing roller 22, a developing agent conveying member 24 and a toner cartridge 26. The developing agent used in the developing means 8 may be a so-called one-component developing agent comprising the toner only that is sent from the toner cartridge 26. By the action of the developing agent conveying member 24 rotated in a direction indicated by an arrow 28, the developing agent is conveyed onto the developing agent replenishing roller 22 and is fed onto the developing roller 18 by the developing agent replenishing roller 22 that is rotated in a direction indicated by an arrow 30. The developing agent held on the developing roller 18 that is rotated in a direction indicated by an arrow 32 is limited for its thickness to a predetermined value by the developing agent limiting member 20. The developing roller 18 can be constituted by a metallic shaft member 33 and a roller member 34 made of a synthetic rubber disposed on the peripheral surface of the shaft member 33. The developing housing 16 is mounted to move in a direction to approach the rotary drum 12 and in a direction to separate away therefrom, and is further resiliently urged by a suitable resilient means (not shown) in a direction to approach the rotary drum 12. Therefore, the developing roller 18 is resiliently pressed against the rotary drum 12. As will be described later, furthermore, a toner cartridge 26 is detachably mounted on the developing housing 16.

With further reference to FIG. 1, the cleaning means 10 includes a cleaning housing 36 as well as a cleaning blade 38 and a spiral vane member 40 disposed in the cleaning housing 36. The cleaning blade 38 is made of a soft material such as synthetic rubber, and the end thereof is pushed against the peripheral surface of the rotary drum 12. The spiral vane member 40 rotates in a direction indicated by an arrow 42.

The above-mentioned imaging unit is detachably mounted on a required position of the machine housing (not shown) of the image-forming machine which may be, for example, an electrostatic copying machine. The rotary drum 12 is rotated in a direction indicated by an arrow 14, and the peripheral surface of the rotary drum 12 is uniformly charged to a predetermined polarity in a charging zone 35. Then, in an exposing zone 37, the peripheral surface of the rotary drum 12 is irradiated with light correspondingly to an image that is to be formed through a suitable optical system (not shown) and thus, an electrostatic latent image is formed on the peripheral surface of the rotary drum 12. Next, the electrostatic latent image on the peripheral surface of the rotary drum 12 is developed into a toner image by the action of the developing roller 18 of the developing means 8 in the developing zone 39. In a transfer zone 41, the transfer member (not shown) which may be a common paper is brought into intimate contact with the peripheral surface of the rotary drum 12, and the toner image formed on the peripheral surface of the rotary drum 12 is transferred onto the transfer member. The transfer member onto which the toner image is transferred is peeled off from the peripheral surface of the rotary drum 12, conveyed to a fixing means (not shown) where the toner image is fixed by the action of the fixing means, and is discharged out of the machine housing. In a cleaning zone 43, the residual toner remaining on the peripheral surface of the rotary drum 12 after the image has been transferred is removed from the peripheral surface of the rotary drum 12 by the action of the cleaning blade 38. The toner removed from the peripheral surface of the rotary drum 12 is allowed to flow toward the spiral vane member 40 and is transferred backwards by the action of the spiral vane member 40 that is rotated in the direction indicated by the arrow 42 (the action of the spiral vane member 40 will be described later).

The above-mentioned constitution and action of the imaging unit do not constitute a novel feature of the imaging unit of the present invention and are known among the persons skilled in the art. Therefore, their details are not described in this specification.

Figure 2:
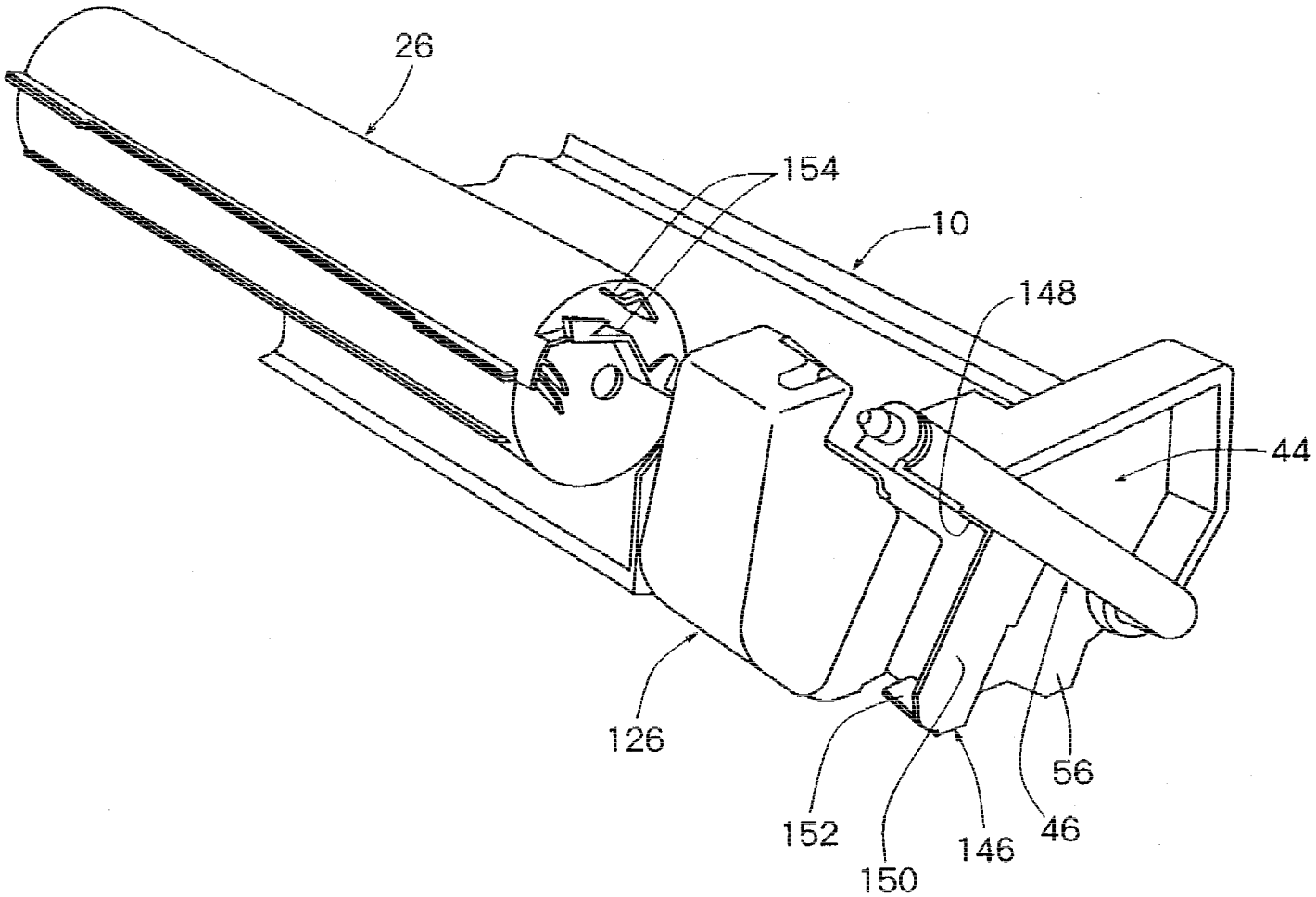
FIG. 2 is a perspective view of when the imaging unit shown in FIG. 1 is viewed from the back.
Figure 3:
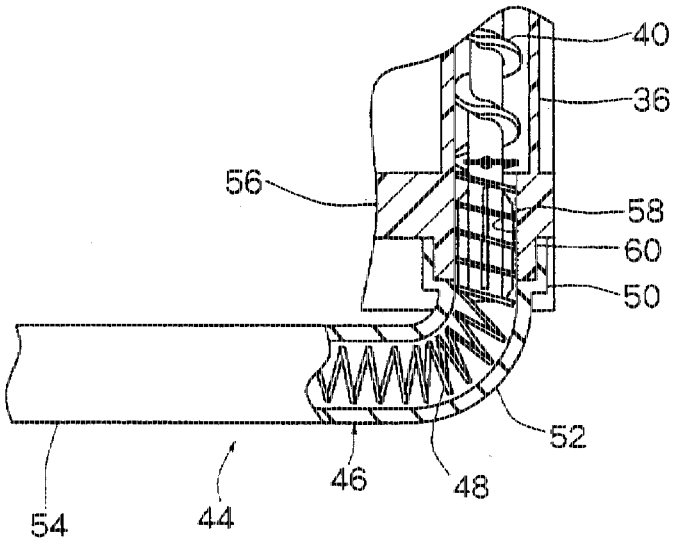
FIG. 3 is a sectional view illustrating an upstream end portion of the toner conveying mechanism arranged in the imaging unit shown in FIG. 1.

With reference to FIGS. 2 and 3 together with FIG. 1, the cleaning means 10 includes also a toner conveying mechanism 44. The toner conveying mechanism 44 is constituted by a toner conveying pipe member 46 and a coil member 48 which extends within the toner conveying pipe member 46. The toner conveying pipe member 46 includes an upstream end portion 50 extending in the center axial direction of the rotary drum 12 (up-and-down direction in FIG. 3), a curved portion 52 and a main portion 54 extending straight and substantially vertically with respect to the center axis of the rotary drum 12. The upstream end portion 50 and the main portion 54 that are continuously connected with each other via the curved portion 52, make an angle of about 90 degrees with each other. As clearly shown in FIG. 3, a circular opening 58 is formed in a rear wall 56 of the frame means 2, and a cylindrical protrusion 60 is formed protruding rearwardly from the peripheral edge of the circular opening 58. The rear end portion of the spiral vane member 40 of the cleaning means 10 protrudes into the cylindrical protrusion 60 passing through the circular opening 58. The upstream end portion of the toner conveying pipe member 46 has a diameter slightly greater than that of other portions, and has an inner diameter that corresponds to, or in further detail, that is slightly smaller than the outer diameter of the cylindrical protrusion 60. The upstream end of the toner conveying pipe member 46 is resiliently deformed to some extent and is forcibly fitted into the cylindrical protrusion 60 so as to be coupled to the cylindrical protrusion 60. Thus, the toner conveying pipe member 46 is communicated with the cleaning housing 36 through the circular opening 58. The main portion 54 of the toner conveying pipe member 46 extends from the back of the rear wall 56 of the frame means 2 (lower portion in FIG. 3) toward the downstream side being tilted upwards. The upstream end portion of the coil member 48 that can be made of a suitable metal wire such as a stainless steel wire is wound up on the rear end portion of the spiral vane member 40 as clearly shown in FIG. 3. When the spiral vane member 40 is rotated in the direction indicated by the arrow 42 (FIG. 1), therefore, the coil member 48 also rotates in response thereto in the direction indicated by the arrow 42. By the action of the spiral vane member 40 which is thus rotated, the toner is rearwardly conveyed (downwardly in FIG. 3) in the cleaning housing 36 and is sent to the toner conveying pipe member 46 from the cleaning housing 36 and is conveyed in the toner conveying pipe member 46 by the action of the coil member 48. As will be understood with reference to FIGS. 4 and 5, the downstream end portion of the toner conveying pipe member 46 has a locally flat surface, and a rectangular toner discharge opening 62 is formed in this flat surface (constitution related to the downstream end portion of the toner conveying pipe member 46 will be described later in further detail).

It is desired that the toner conveying pipe member 46 of the toner conveying mechanism 44 is made of a synthetic rubber. In particular, it is desired that the toner conveying pipe member 46 is made of a synthetic rubber having a hardness of from 50 to 70, particularly from 55 to 65, as measured according to the spring-type hardness test model-A stipulated under JIS-K-6301. An urethane rubber is an example of the synthetic rubber suited for forming the toner conveying pipe member 46. The present inventors know empirically that when the toner conveying pipe member 46 is made of a synthetic resin such as ABS resin and when the toner is not sent in a sufficient amount into the toner conveying pipe member 46, the coil member 48 that is rotated rubs the inner peripheral surface of the toner conveying pipe member 46 to generate noise to a considerable degree. This noise decreases when the toner is made present in a considerable amount in the toner conveying pipe member 46 since the toner works as a lubricant. When the toner conveying pipe member 46 is made of a synthetic rubber, on the other hand, generation of noise is suppressed to a sufficient degree even before the toner is sent in a sufficient amount into the toner conveying pipe member 46. When the hardness of the synthetic rubber forming the toner conveying pipe member 46 is too large, the effect to suppress the noise can not be achieved to a sufficient degree and it becomes difficult to mold the toner conveying pipe member 46 in a required shape. When the synthetic rubber forming the toner conveying pipe member 46 has a too small hardness, on the other hand, the so-called shape-retaining property becomes so small that the toner conveying pipe member 46 tends to be deformed due to its own weight, weight of the coil member 48 and weight of the toner existing in the toner conveying pipe member 46.

Figure 4:
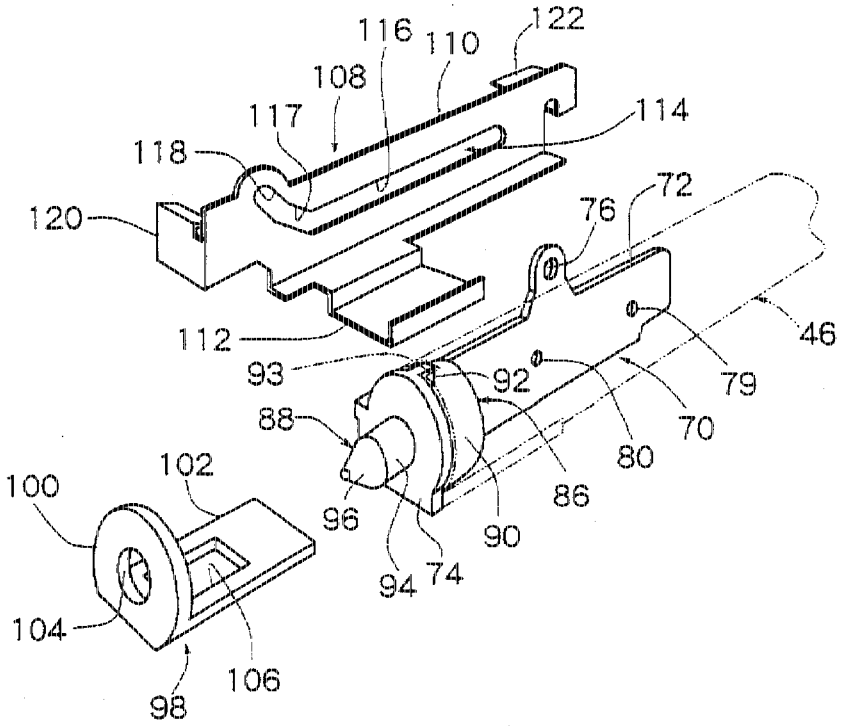
FIG. 4 is a perspective view illustrating, in a disassembled manner, a positioning member, a sealing member and a shutter member arranged in the toner conveying mechanism in the imaging unit shown in FIG. 1.
Figure 5:
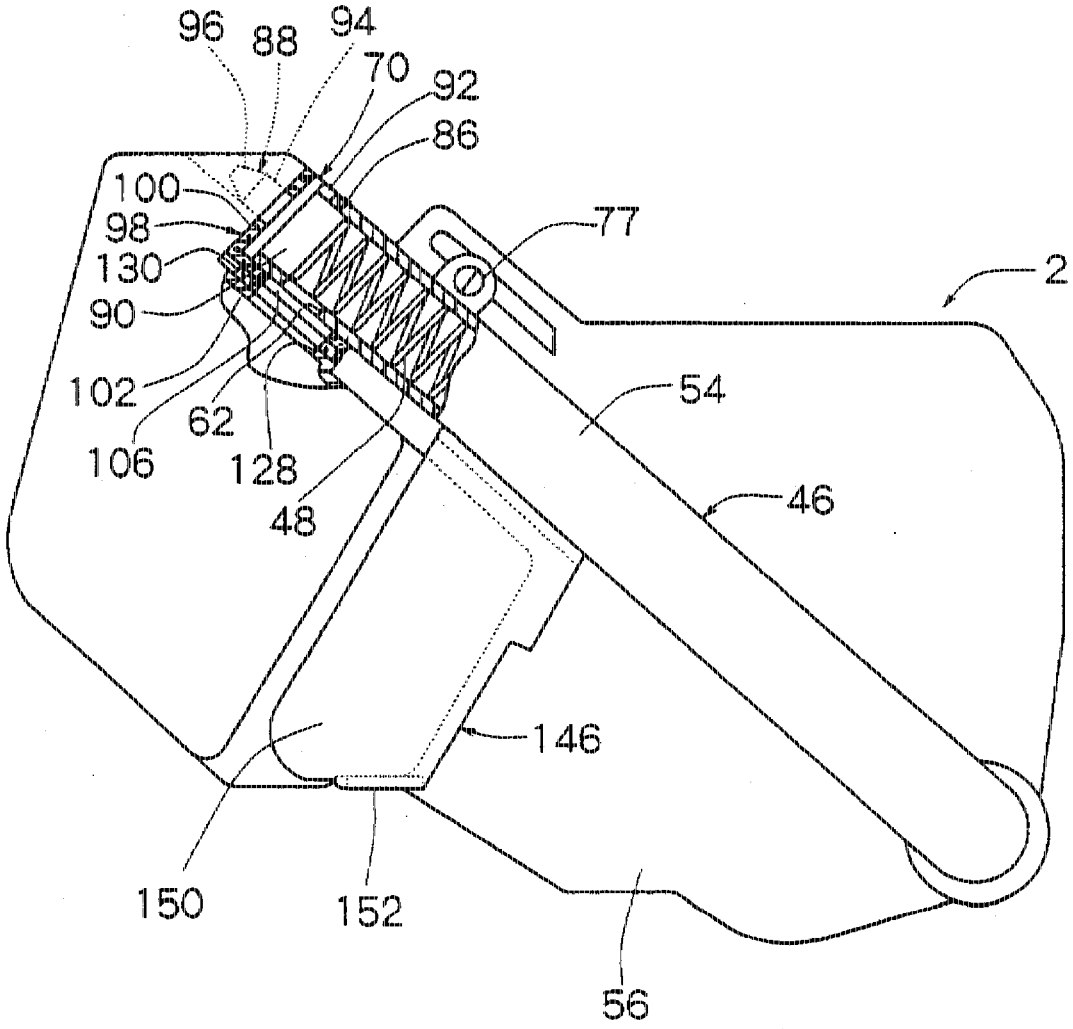
FIG. 5 is a back view illustrating, partly in cross section, the imaging unit shown in FIG. 1.

With reference to FIG. 2 as well as FIGS. 4 and 5, a positioning member 70 which can be formed of a suitable synthetic resin such as ABS resin is secured to the outer surface of the rear wall 56 of the frame means 2. The positioning member 70 has a base portion 72 that extends along the rear wall 56 of the frame means 2 and a main portion 74 that extends rearwardly from the end of the base portion 72 (left end in FIGS. 4 and 5). The main portion 74 rearwardly protrudes substantially perpendicularly to the base portion 72. In FIGS. 4 and 5, the base portion 72 of the positioning member 70 extends leftwardly being tilted upwards. The base portion 72 has a protruded portion protruding upwards, and a hole 76 is formed in the protruded portion. A stop screw 77 (FIG. 5) is screwed into a threaded hole 78 (FIGS. 6 and 7) formed in the rear wall 56 of the frame means 2 through the hole 76, in order to secure the positioning member 70 to the rear wall 56 of the frame means 2. A pair of holes 79 and 80 are formed in the base portion 72 of the positioning member 70, spaced away from each other, in the lengthwise direction. In the pair of holes 79 and 80 are inserted the ends of a pair of guide pins 82 and 84 (FIGS. 6 and 7) formed on the rear wall 56 of the frame means 2. The pair of guide pins 82 and 84 rearwardly protrude substantially horizontally from the rear wall 56 (function of the guide pins 82 and 84 will be described later). On the main portion 74 of the positioning member 70 are formed a first coupling means 86 and a second coupling means 88. The outer shape of the main portion 74 of the positioning member 70 or, in further detail, the outer shape of a portion between the first coupling means 86 and the second coupling means 88, nearly corresponds to the outer shape of the downstream end portion of the toner conveying pipe member 46, and the lower edge is straight instead of being arcuate. The first coupling means 86 is constituted by a cylindrical main portion 90 which rightwardly protrudes in FIGS. 4 and 5 and a nearly rectangular protrusion 92 formed on the upper surface of the base end of the cylindrical main portion 90. The outer diameter of the cylindrical main portion 90 corresponds to the inner diameter of the end portion of the toner conveying pipe member 46 or, in further detail, is slightly larger than the inner diameter of the end portion of the toner conveying pipe member 46. The protrusion 92 corresponds to a nearly rectangular notch 93 formed in the upper surface of the end portion of the toner conveying pipe member 46. The second coupling means 88 protrudes in a direction opposite to the first coupling means 86, i.e., leftwardly protrudes in FIGS. 4 and 5. The second coupling means 88 is constituted by a cylindrical base portion 94 and a conical end portion 96. The outer diameter of the cylindrical base portion 94 is slightly smaller than the outer diameter of the cylindrical main portion 90 of the first coupling means 86. As will be clearly understood with reference to FIG. 5, the center axis of the cylindrical main portion 90 of the first coupling means 86 is in agreement with the center axis of the cylindrical base portion 94 and the conical end portion of the second coupling means 88, and is further in agreement with the center axis of the main portion 54 of the toner conveying pipe member 46.

With further reference to FIGS. 4 and 5, a sealing member 98 which is preferably made of a sponge is attached to the positioning member 70. The sealing member 98 has a mounting portion 100 and a belt-shaped sealing portion 102 which rightwardly extends from the lower end of the mounting portion 100 and is downwardly tilted as shown in FIGS. 4 and 5. A circular opening 104 is formed in the central portion of the mounting portion 100. A rectangular opening 106 is formed in the sealing portion 102. The inner diameter of the circular opening 104 formed in the mounting portion 100 corresponds to the outer diameter of the cylindrical base portion 94 of the second coupling means 88 disposed on the positioning member 70. As will be understood with reference to FIG. 5, as the cylindrical base portion 94 extends passing through the opening 104 of the mounting portion 100, the sealing member 98 is fitted to the main portion 74 of the positioning member 70. When the upstream end portion of the toner conveying pipe member 46 is coupled to the first coupling means 86 of the positioning member 70 as will be described later, the sealing portion 102 of the sealing member 98 extends along the lower surface of the end portion of the toner conveying pipe member 46, and the opening 106 formed in the sealing portion 102 is brought into match with the toner discharge opening 62 formed in the toner conveying pipe member 46.

Figure 6:
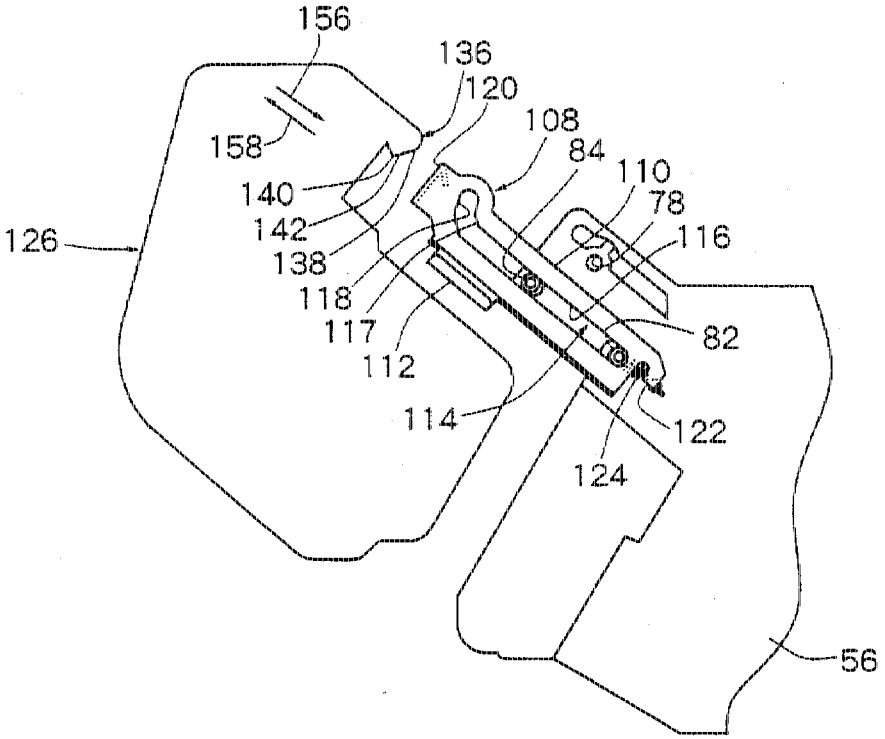
FIG. 6 is a schematic view illustrating the shutter member used for the imaging unit shown in FIG. 1 in a state before a toner-recovering container is mounted.
Figure 7:
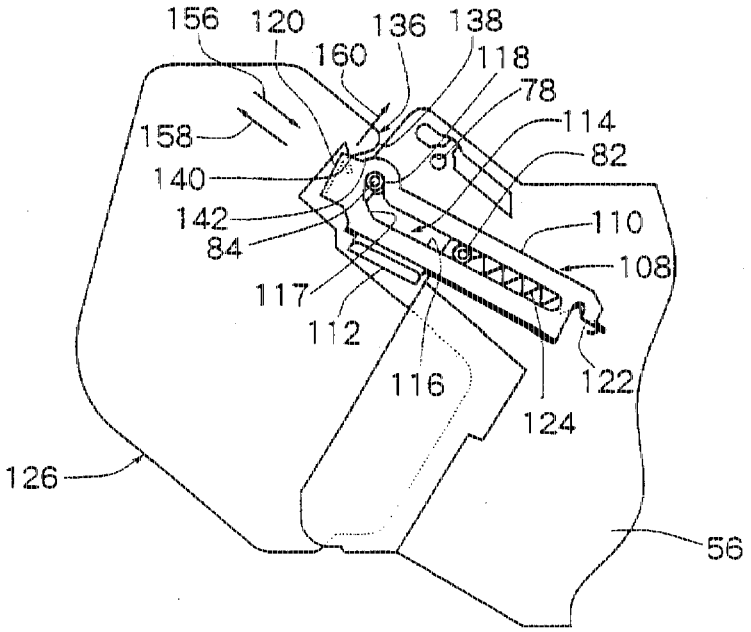
FIG. 7 is a schematic view illustrating the shutter member used for the imaging unit shown in FIG. 1 in a state after the toner-recovering container is mounted.

With reference to FIGS. 4 and 5 together with FIGS. 6 and 7, a shutter member 108 that can be made of a thin metal plate such as a thin stainless steel plate is mounted on the outer surface of the rear wall 56 of the frame means 2. The shutter member 108 has a base portion 110 that extends along the rear wall 56 of the frame means 2 and a main portion 112 that rearwardly extends from the lower edge of the base portion 110. A slot 114 is formed in the base portion 110. The slot 114 has a main portion 116 that extends straight in the lengthwise direction of the base portion 110, a first inclined portion 117 extending being inclined upwards continuing from the main portion 116, and a second inclined portion 118 extending being further inclined upwards continuing from the first inclined portion 117. The angle of inclination of the second inclined portion 118 with respect to the main portion 116 is slightly larger than the angle of inclination of the first inclined portion 117 with respect to the main portion 116. The slot 114 may have substantially the same width over the full length thereof. The base portion 110 has at its front end (left end in FIGS. 6 and 7) a to-be-contacted portion 120 that protrudes forward. The base portion 110 further has at its rear end (right end in FIGS. 6 and 7) an engaging portion 122 that protrudes forward. The main portion 112 of the shutter member 108 has a channel shape in its lateral cross section and has a width that corresponds to the width of the flat lower surface of the downstream end portion of the toner conveying pipe member 46 (and corresponds to the width of the sealing portion 102 of the sealing member 98). The base portion 110 of the shutter member 108 is positioned between the rear wall 56 of the frame means 2 and the base portion 72 of the positioning member 70. In the slot 114 formed in the base portion 110 of the shutter member 108 are inserted the pair of guide pins 82 and 84 that rearwardly protrude substantially horizontally from the rear wall 56 of the frame means 2. Thus, the shutter member 108 is allowed to move between the close position shown in FIG. 6 and the open position shown in FIG. 7. The slot 114 and the pair of guide pins 82 and 84 work in cooperation to constitute a guide means which defines a passage for moving the shutter member 112 between the close position and the open position. At the close position shown in FIG. 6, the guide pin 82 comes into contact with the rear end of the slot 114 and at the open position shown in FIG. 7, the guide pin 84 is positioned in contact with, or being close to, the end of the slot 114. A tension coil spring 124 is stretched between the guide pin 82 and the engaging portion 122 of the shutter member 108. A spring 124 constituting the resilient urging means resiliently urges the shutter member 108 toward the close position shown in FIG. 6.

As will be understood with reference to FIGS. 2, 4 and 5, the end portion of the toner conveying pipe member 46 is coupled to the first coupling means 86 of the positioning member 70. In further detail, the end portion of the toner conveying pipe member 46 is elastically deformed to some extent and is fitted onto the cylindrical main portion 90 of the first coupling means 86 formed in the positioning member 70, whereby the open end of the toner conveying pipe member 46 is closed. The notch 93 formed in the upper surface at the end portion of the toner conveying pipe member 46 is brought into engagement with the protrusion 92 of the first coupling means 86. Thus, the end portion, (i.e., portion near the toner discharge opening 62) of the toner conveying pipe member 46 is coupled to the first coupling means 86 of the positioning member 70, whereby the end portion of the toner conveying pipe member 46 is placed in the predetermined position and hence, the toner discharge opening 62 formed in the lower surface at the end of the toner conveying pipe member 46 is placed in the predetermined position. When the end portion of the toner conveying pipe member 46 is not coupled to the first coupling means 86 of the positioning member 70, the end portion of the toner conveying pipe member 46, i.e., the position of the toner discharge opening 62 becomes instable to a considerable degree, since the toner conveying pipe member 46 made of the synthetic rubber is so soft.

With reference to FIGS. 4 and 5 together with FIGS. 6 and 7, in order to couple the end portion of the toner conveying pipe member 46 to the first coupling means 86 of the positioning member 70 as described above, the to-be-contacted portion 120 of the shutter member 108 is pushed by a finger to move the shutter member 108 to the open position shown in FIG. 7 against the resilient urging action of the coil spring 124 and must be held at this open position. And, after the end portion of the toner conveying pipe member 46 is coupled to the first coupling means 86 of the positioning member 70, the finger is detached from the to-be-contacted portion 120 of the shutter member 108, and the shutter member 108 is returned back to the close position shown in FIGS. 5 and 6 by the resilient urging action of the coil spring 124. With the end portion of the toner conveying pipe member 46 being coupled to the first coupling means 86 of the positioning member 70, the sealing portion 102 of the sealing member 98 extends along the lower surface of the end portion of the toner conveying pipe member 46 as will be understood with reference to FIGS. 4 and 5, whereby the opening 106 formed in the sealing portion 102 of the sealing member 98 is brought into match with the toner discharge opening 62 formed in the lower surface of the end portion of the toner conveying pipe member 46. Next, as the shutter member 108 is returned back to the close position shown in FIGS. 5 and 6, the sealing portion 102 of the sealing member 98 is compressed between the lower surface of the end portion of the toner conveying pipe member 46 and the main portion 112 of the shutter member 108, and the toner discharge opening 62 of the toner conveying pipe member 46 is sealed very reliably. When the end portion of the toner conveying pipe member 46 is coupled to the first coupling means 86 of the positioning member 70 in a state where the shutter member 108 is at the close position shown in FIGS. 5 and 6, the sealing portion 102 of the sealing member 98 is compressed in an undesired shape between the main portion 112 of the shutter member 108 and the end portion of the toner conveying pipe member 46, whereby the end portion of the toner conveying pipe member 46 is not coupled to the first coupling means 86 of the positioning member 70, and the sealing portion 102 of the sealing member 98 tends to be damaged. When the shutter member 108 is moved to the open position from the close position as will be understood from the comparison of FIG. 6 with FIG. 7, the guide pin 84 moves relatively along the main portion 116 of slot 114 of the shutter member 108, along the first inclined portion 117 and along the second inclined portion 118. Therefore, the shutter member 108 moves along the cylindrical main portion 90 of the first coupling member 86 (i.e., along the toner conveying pipe member 46 coupled to the first coupling member 86) and, then, moves downwardly to separate away from the cylindrical main portion 90 (i.e., in a direction to separate away from the lower surface of the end portion of the toner conveying pipe member 46 coupled to the first coupling means 86). Therefore, when the end portion of the toner conveying pipe member 46 is coupled to the first coupling means 86 of the positioning member 70 by holding the shutter member 108 at the open position shown in FIG. 7 or, in other words, by holding the shutter member 108 in a state separated away from the lower surface of the toner conveying pipe member 46, then, the coupling operation is accomplished very easily without causing undesirable deformation of the sealing portion 102 of the sealing member 98.

Figure 8:
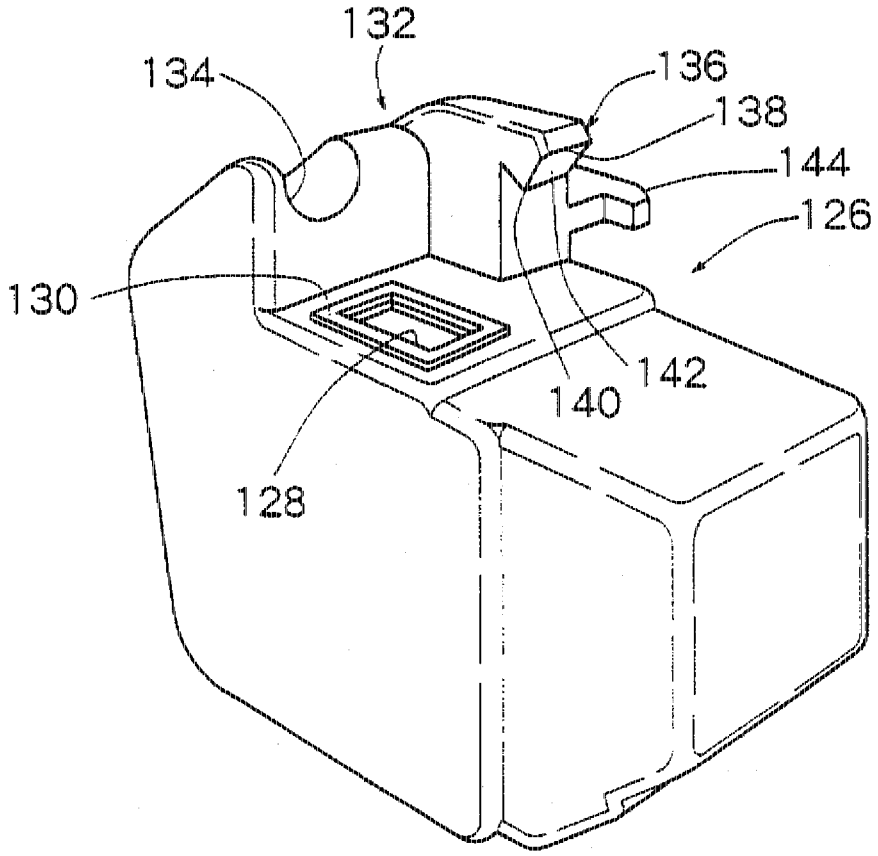
FIG. 8 is a perspective view illustrating the toner-recovering container used for the imaging unit shown in FIG. 1.

With reference to FIG. 8 together with FIG. 2, the cleaning means 10 further includes a toner-recovering container 126. A toner receiving opening 128 of a rectangular shape is formed in the upper surface of the toner-recovering container 126 that can be made of a suitable synthetic resin. A sealing member 130 surrounding the toner receiving opening 128 is stuck to the upper surface of the toner-recovering container 126. The sealing member 130 can be made of a soft material such as sponge. As clearly shown in FIG. 8, an upwardly protruded portion 132 is formed near the toner receiving opening 128 on the toner-recovering container 126, and a limiting groove 134 is formed in the protruded portion. The groove 134 has an arcuate bottom surface with its upper surface being open. The radius of curvature of the arcuate bottom surface of the groove 134 corresponds to the radius of curvature of the cylindrical base portion 94 of the second coupling means 88 formed in the positioning member 70. A contact portion 136 is formed also on the protruded portion 132 of the toner-recovering container 126. The contact portion 136 has a first contact end 138 and a second contact end 140, and an inclined surface 142 extends between the first contact end 138 and the second contact end 140. An engaging means 144 is also formed on one surface of the protruded portion 132 of the toner-recovering container 126.

As clearly shown in FIG. 2, a receiving piece 146 is formed on the outer surface of the rear wall 56 of the frame means 2. The receiving piece 146 has a portion 148 which rearwardly protrudes from the rear wall 56, a portion 150 which downwardly extends from the end of the portion 148, and a portion 152 which extends toward the rear wall 56 from the lower end of the portion 150. The toner conveying pipe member 46 extends above the portion 148 of the receiving piece 146.

With further reference to FIGS. 1, 2 and 8, the toner-recovering container 126 of the cleaning means 10 is coupled to one side, i.e., to the rear side, of the toner cartridge 26 in the developing means 8 in the illustrated embodiment. Referring to FIG. 2, a to-be-engaged means 154 is disposed on the rear side of the toner cartridge 26. Upon engaging the engaging means 144 of the toner-recovering container 126 with the to-be-engaged means 154, the toner-recovering container 126 is detachably coupled to the toner cartridge 26. The toner cartridge 26 is moved in a direction indicated by an arrow 156 shown in FIGS. 6 and 7 so as to be mounted on the developing housing 16 of the developing means 8, and is moved in a direction indicated by an arrow 158 in FIGS. 6 and 7 so as to be removed from the developing housing 16 of the developing means 8. With the movement of the toner cartridge 26, the toner-recovering container 126 is mounted on a predetermined position of the frame means 2 and is removed from the predetermined position of the frame means 2. The manner of coupling the toner-recovering container 126 to the toner cartridge 26 and the manner of mounting the toner cartridge 26 on the developing housing 16 do not constitute novel features of the imaging unit of the present invention, and pertain to the widely known technology. Therefore, they are not described in detail in this specification.

With reference to FIGS. 2 and 5 together with FIGS. 6 and 7, when the toner cartridge 26 is moved in the direction indicated by the arrow 156 to be mounted on the developing housing 16, the toner-recovering container 126 also moves in the direction indicated by the arrow 156 with the movement of the toner cartridge 26, i.e., moves from a position shown in FIG. 6 to a position shown in FIG. 7. As the toner-recovering container 126 is moved up to a position shown in FIG. 7, the front end of the toner-recovering container 126 as viewed in the moving direction indicated by the arrow 156 enters into the space between the outer surface of the rear wall 56 of the frame means 2 and the receiving piece 146. As will be understood with reference to FIGS. 2, 5 and 8, furthermore, when the toner-recovering container 126 is moved in the direction indicated by the arrow 156 from the position shown in FIG. 6 to the position shown in FIG. 7, the second coupling means 88 formed in the positioning member 70 is received by the limiting groove 134 of the toner-recovering container 126. The radius of curvature of the arcuate bottom surface of the limiting groove 134 of the toner-recovering container 126 corresponds to the radius of curvature of the cylindrical base portion 94 of the second coupling means 88 formed in the positioning member 70. Therefore, when the cylindrical base portion 94 of the second coupling means 88 is received by the limiting groove 134, the protruded portion 132 of the toner-recovering container 126 is placed in the predetermined position and hence, the toner receiving opening 128 formed in the upper surface of the toner-recovering container 126 is placed in the predetermined position. The movement of the toner-recovering container 126 with respect to the positioning member 70 in the direction perpendicular to the surface of the paper and upwards in FIGS. 5 and 7, is prevented as the cylindrical base portion 94 of the second coupling means 88 is received by the limiting groove 134. The downward movement of the toner-recovering container 126 with respect to the positioning member 70 in FIGS. 5 and 7 is prevented as the front end of the toner-recovering container 126 comes into contact with the upper surface of the portion 152 of the receiving piece 146.

As will be clearly understood with reference to FIGS. 6 and 7, furthermore, when the toner-recovering container 126 is moved from the position shown in FIG. 6 to the position shown in FIG. 7, the contact portion 136 of the toner-recovering container 126 comes into contact with the to-be-contacted portion 120 of the shutter member 108, causing the shutter member 108 to move to the open position shown in FIG. 7 from the close position shown in FIG. 6 against the resilient urging force of the coil spring 124. As the shutter member 108 is brought to the open position, the toner discharge opening 62 formed in the toner conveying pipe member 46 is open and is communicated with the toner receiving opening 128 of the toner-recovering container 126. Therefore, the toner conveyed in the toner conveying pipe member 46 is discharged through the toner discharge opening 62, and is recovered by the toner-recovering container 126 through the toner receiving opening 128. As described above, the end portion of the toner conveying pipe member 46 is coupled to the first coupling means 86 of the positioning member 70, whereby the toner discharge opening 62 of the toner conveying pipe member 46 is placed in the predetermined position with respect to the positioning member 70. Moreover, the second coupling means 88 of the positioning member 70 is coupled to the limiting groove 134 of the toner-recovering container 126, whereby the toner receiving opening 128 of the toner-recovering container 126 is placed in the predetermined position with respect to the positioning member 70. Thus, the toner discharge opening 62 and the toner receiving opening 128 are brought into alignment with each other with high precision and are communicated with each other.

Attention should also be given to the following fact in moving the shutter member 108 for mounting the toner-recovering container 126. In the initial stage in which the shutter member 108 is moved from the close position toward the open position, the first contact end 138 of the contact portion 136 formed on the toner-recovering container 126 comes into contact with the to-be-contacted portion 120 of the shutter member 108 to cause the shutter member 108 to move along the toner conveying pipe member 46. As the guide pin 84 moves relatively along the second inclined portion 118 from the first inclined portion 117 of the slot 114 formed in the shutter member 108, however, the shutter member 108 moves in a direction to separate away from the toner conveying pipe member 46. Then, the inclined surface 142 of the contact portion 136 of the toner-recovering container 126 comes into contact with the to-be-contacted portion 120 of the shutter member 108, and when the shutter member 108 moves to the open position shown in FIG. 7, the second contact end 140 of the contact portion 136 comes into contact with the to-be-contacted portion of the shutter member 108. In a state where the first contact end 138 of the contact portion 136 is in contact with the to-be-contacted portion 120 of the shutter member 108, a force exerted on the toner-recovering container 126 by the shutter member 108 is in a direction indicated by an arrow 158 due to the resilient urging force of the coil spring 124. In the state where the second contact end 140 of the contact portion 136 comes into contact with the to-be-contacted portion 120 of the shutter member 108 as shown in FIG. 7, however, the force exerted on the toner-recovering container 126 by the shutter member 108 is in a direction indicate by an arrow 160 which is substantially perpendicular to the arrow 158 due to the resilient urging force of the coil spring 124. In the illustrated embodiment, as described above, the developing housing 16 of the developing means 8 is resiliently urged by a resilient means (not shown) in a direction to approach the rotary drum 12, whereby the developing roller 18 is resiliently pushed against the rotary drum 12. And, the force exerted on the toner-recovering container 126 is transmitted to the developing housing 16 via the toner cartridge 26 in a state where the toner cartridge 26 and the toner-recovering container 126 are mounted in the required positions. When the force is in the direction of the arrow 158 in which the developing roller 18 is pushed against the rotary drum 12, the developing roller 18 pushed against the rotary drum 12 may be adversely influenced by the force exerted on the toner-recovering container 126 due to the resilient urging force of the coil spring 124. When the force exerted on the toner-recovering container 126 is in the direction indicated by the arrow 160 which is substantially perpendicular to the direction of the arrow 158, however, the developing roller 18 that is pushed against the rotary drum 12 is not substantially affected adversely by the force exerted on the toner-recovering container 126 due to the resilient urging force of the coil spring 124.

When the toner in the toner cartridge 26 is substantially all consumed, the toner cartridge 26 is moved in the direction indicated by the arrow 158 and is removed from the developing housing 16. With removal of the toner cartridge 26, the toner-recovering container 126 is removed from the frame means 2. To continuously use the imaging unit, a new toner cartridge 26 is mounted and a new toner-recovering container 126 fitted thereto is mounted.

In the foregoing were described in detail preferred embodiments of the imaging unit constituted according to the present invention with reference to the accompanying drawings. The present invention, however, is in no way limited to such embodiments only but can be varied and modified in a variety of ways without departing from the scope of the present invention.

What we claim is:

1. An imaging unit applied to an image-forming machine, comprising:

a frame means, an image-carrying means mounted on said frame means, for forming a toner image thereon for transference to a transfer member, and a cleaning means mounted on said frame means, for removing toner remaining on said image-carrying means after a toner image has been transferred to a transfer member, said cleaning means including a toner conveying pipe member defining a passage for conveying the toner removed from said image-carrying means, the toner conveying pipe member defining a toner discharge opening therein, a toner conveying means for conveying the toner through said toner conveying pipe member, a toner-recovering container detachably combinable to said toner conveying pipe member, the toner-recovering container defining a toner receiving opening therein for communication with said toner discharge opening when said toner-recovering container is combined to said toner conveying pipe member; and a positioning member disposed on said frame member, said positioning member including a first coupling means couplable to said toner conveying means near said toner discharge opening and a second coupling means couplable to said toner-recovering container near said toner receiving opening, such that when said first coupling means is coupled to said toner conveying means near said toner discharge opening and said second coupling means is coupled to said toner-recovering container near said toner receiving opening, said toner discharge opening of said toner conveying pipe member and said toner receiving opening of said toner-recovering container are positioned relative to each other for communication therebetween via said positioning member.

2. An imaging unit according to claim 1, wherein said positioning member is made of a synthetic resin.

3. An imaging unit according to claim 1, wherein an end of said toner conveying pipe member is open, and said first coupling means of said positioning member is coupled to said toner conveying pipe member by insertion into said toner conveying pipe member through the open end of said toner conveying pipe member in order to limit a position of the end of said toner conveying pipe member and to close the end of said toner conveying pipe member.

4. An imaging unit according to claim 1, wherein said toner-recovering container has a limiting groove, and said second coupling means of said positioning member is coupled to said toner-recovering container by insertion into said limiting groove of said toner-recovering container to limit a position of said toner-recovering container.

5. An imaging unit according to claim 1, wherein said toner conveying pipe member is made of a synthetic rubber.

6. An imaging unit according to claim 5, wherein said synthetic rubber has a hardness of from 50 to 70 as measured by the spring-type hardness test model-A stipulated under JIS-K-6301.

7. An imaging unit according to claim 6, wherein said synthetic rubber has a hardness of from 55 to 65 as measured by the spring-type hardness test model-A stipulated under JIS-K-6301.

8. An imaging unit according to claim 1, wherein said toner discharge opening is defined in a side surface of said toner conveying pipe member, a shutter member capable of moving between a close position for closing said toner discharge opening and an open position for opening said toner discharge opening is disposed on said frame means, a sealing member is disposed so as to be compressed between the side surface of said toner conveying pipe member and an inner surface of said shutter member when said shutter member is brought to said close position, and a guide means is disposed to limit the moving passage of said shutter member between said close position and said open position, said guide means guiding said shutter member to move along the toner conveying pipe member and to move in a direction to separate away from, or approach, the side surface of said toner conveying pipe member.

9. An imaging unit according to claim 8, wherein the cleaning means further includes a resilient urging means for resiliently urging said shutter member to said close position, said shutter member has a to-be-contacted portion, and said toner-recovering container has a contact portion, such that, when said toner-recovering container is combined with said toner conveying pipe member, said contact portion acts on said to-be-contacted portion to cause said shutter member to move to said open position from said close position against the action of said resilient urging means.

10. An imaging unit according to claim 9, wherein when said shutter member moves from said close position to said open position, said guide means moves along said toner conveying pipe member and further moves in a direction to separate away from the side surface of said toner conveying pipe member.

11. An imaging unit according to claim 10, wherein a developing means for developing an electrostatic latent image formed on said image-carrying means into a toner image is mounted on said frame means, said developing means including a developing roller which is resiliently pushed against said image-carrying means and a detachable toner cartridge, said toner-recovering container is mounted on said toner cartridge, and said toner cartridge is mounted on said frame means and combined to said toner conveying pipe member by mounting on said developing means, and a resilient urging force exerted on said toner-recovering container by said resilient urging means via said shutter member in a state where said shutter member is located at said open position is in a direction substantially not affecting the pushing force of said developing roller against said image-carrying means.

12. An imaging unit applied to an image-forming machine, comprising a frame means, an image-carrying means mounted on said frame means, for forming a toner image thereon for transference to a transfer member, and a cleaning means mounted on said frame means, for removing toner remaining on said image-carrying means after a toner image has been transferred to a transfer member, said cleaning means including a toner conveying pipe member defining a passage for conveying the toner removed from said image-carrying means, the toner conveying pipe member defining a toner discharge opening at a side surface thereof, a toner conveying means for conveying the toner through said toner conveying pipe member, a toner-recovering container detachably combinable to said toner conveying pipe member, the toner-recovering container defining a toner receiving opening therein for communication with said toner discharge opening when said toner-recovering container is combined to said toner conveying pipe member;

a shutter member capable of moving between a close position for closing the toner discharge opening and an open position for opening the toner discharge opening, the shutter member being disposed on said frame means, a sealing member being disposed so as to be compressed between the side surface of said toner conveying pipe member and an inner surface of said shutter member when said shutter member is brought to the close position, and a guide means being disposed to limit the moving passage of said shutter member between said close position and said open position, said guide means guiding said shutter member to move along said toner conveying pipe member and to move in a direction to separate away from, or approach, the side surface of said toner conveying pipe member.

13. An imaging unit according to claim 12, wherein the cleaning means further includes a resilient urging means for resiliently urging said shutter member to said close position, said shutter member has a to-be-contacted portion, and said toner-recovering container has a contact portion, such that, when said toner-recovering container is combined with said toner conveying pipe member, said contact portion acts upon said to-be-contacted portion to cause said shutter member to move to said open position from said close position against the action of said resilient urging means.

14. An imaging unit according to claim 13, wherein when said shutter member moves from said close position to said open position, said guide means moves along said toner conveying pipe member and further moves in a direction to separate away from the side surface of said toner conveying pipe member.

15. An imaging unit according to claim 14, wherein a developing means for developing an electrostatic latent image formed on said image-carrying means into a toner image is mounted on said frame means, said developing means including a developing roller which is resiliently pushed against said image-carrying means and a detachable toner cartridge, said toner-recovering container is mounted on said toner cartridge, and said toner cartridge is mounted on said frame means and combined to said toner conveying pipe member by mounting on said developing means, and a resilient urging force exerted on said toner-recovering container by said resilient urging means via said shutter member in a state where said shutter member is located at said open position is in a direction substantially not affecting the pushing force of said developing roller against said image-carrying means.

16. A toner conveying mechanism, comprising:

a toner conveying pipe member made of a synthetic rubber having a hardness of from 50 to 70 as measured by the spring-type hardness test model-A stipulated under JIS-K-6301, and a toner conveying means for conveying the toner through said toner conveying pipe member, said toner conveying means including a metallic coil member which extends within said toner conveying pipe member and is rotatably driven.

17. A toner conveying mechanism according to claim 16, wherein said synthetic rubber has a hardness of from 55 to 65 as measured by the spring-type hardness test model-A stipulated under JIS-K-6301.

* * * * *